US012158163B1

(12) United States Patent
Oh et al.

(10) Patent No.: US 12,158,163 B1
(45) Date of Patent: Dec. 3, 2024

(54) ELECTRIC WATER PUMP

(71) Applicants: HYUNDAI MOTOR COMPANY, Seoul (KR); KIA CORPORATION, Seoul (KR)

(72) Inventors: Seoyoung Oh, Hwaseong-si (KR); Seong-Bin Jeong, Seongnam-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 18/630,216

(22) Filed: Apr. 9, 2024

(30) Foreign Application Priority Data

Sep. 19, 2023 (KR) ..... 10-2023-0124602

(51) Int. Cl.
*F04D 29/42* (2006.01)
*F04D 13/06* (2006.01)

(52) U.S. Cl.
CPC ..... *F04D 29/4293* (2013.01); *F04D 13/06* (2013.01)

(58) Field of Classification Search
CPC .... F04D 29/4293; F04D 13/06; F04D 29/426; F04D 29/628; F04D 15/0016
See application file for complete search history.

(56) References Cited

U.S. PATENT DOCUMENTS

2020/0032814 A1* 1/2020 Huang ..... F04D 29/628
2023/0407871 A1* 12/2023 Malone ..... F04D 13/0606

FOREIGN PATENT DOCUMENTS

WO WO-2018210740 A1 * 11/2018 ..... F04D 13/028
WO WO-2019112156 A1 * 6/2019 ..... F04D 13/06

* cited by examiner

*Primary Examiner* — Eldon T Brockman
(74) *Attorney, Agent, or Firm* — Lempia Summerfield Katz LLC

(57) ABSTRACT

An electric water pump includes: a housing in which a cooling water inlet and a plurality of cooling water outlets are formed; a stator provided inside the housing; a rotor that is provided inside the housing and spaced apart from the stator at a predetermined interval in a radial direction; and an impeller provided integrally with an upper portion of the rotor. The electric water pump further includes: a pump body provided between the stator and the rotor, and having a first middle outlet; and a driving device selectively fluidly communicating any one of the plurality of cooling water outlets, and the first middle outlet by rotating the pump body at a predetermined angle.

11 Claims, 12 Drawing Sheets

ELECTRIC WATER PUMP

CROSS-REFERENCE TO RELATED APPLICATION

This application claims priority to and the benefit of Korean Patent Application No. 10-2023-0124602 filed in the Korean Intellectual Property Office on Sep. 19, 2023, the entire contents of which are incorporated herein by reference.

BACKGROUND

(a) Field

The present disclosure relates to an electric water pump, and more particularly, to an electric water pump including a plurality of cooling water outlets.

(b) Description of the Related Art

An air conditioning apparatus applied to eco-friendly vehicles is commonly called a heat pump system.

The heat pump system is equipped with an electric water pump which pumps cooling water. The electric water pump pumps cooling water while an impeller rotates by power generated by a driving motor operated by electric energy.

In recent years, as an electric vehicle is continuously developed, the number of parts that should supply the cooling water has increased.

In order to supply the cooling water to various parts, a path of the cooling water pumped by the electric water pump to a cooling water circuit should be controlled through a valve (e.g., a 3-way vale or a 4-way valve). However, when various valves are disposed in the electric water pump, there is a problem in that manufacturing cost and assembly man-hour of the vehicle increase, and packaging the parts becomes difficult.

The above information disclosed in this Background section is provided only to enhance understanding of the background of the disclosure and therefore it may contain information that does not form the prior art that is already known to a person of ordinary skill in the art.

SUMMARY

The present disclosure has been made in an effort to provide an electric water pump in which functions of an electric water pump and a valve are integrated.

In an embodiment of the present disclosure, an electric water pump includes: a housing in which a cooling water inlet and a plurality of cooling water outlets are formed; a stator provided inside the housing; and a rotor provided inside the housing. The rotor is provided to be spaced apart from the stator at a predetermined interval in a radial direction of the rotor. The electric water pump further includes an impeller provided integrally with an upper portion of the rotor; a pump body provided between the stator and the rotor and having a first middle outlet; and a driving device selectively fluidly communicating any one of the plurality of cooling water outlets, and the first middle outlet by rotating the pump body at a predetermined angle.

In some embodiments, the housing may include an upper housing, a middle housing provided below the upper housing, and a lower housing provided below the middle housing. The stator, the rotor, the impeller, and the pump body may be provided between the upper housing and the middle housing.

In some embodiments, the stator may be fixedly installed on an inner side of the middle housing.

In some embodiments, the cooling water inlet may be formed at an upper center of the upper housing, and the plurality of cooling water outlets may be formed on a side surface of the upper housing.

In some embodiments, the cooling water outlet may include a first cooling water outlet, and a second cooling water outlet spaced apart from the first cooling water outlet at a predetermined angle in a circumferential direction of the upper housing.

In some embodiments, the driving device may be provided inside the lower housing.

In some embodiments, the rotor may include a rotation body, and at least one magnetic body provided outside in a radial direction of the rotation body.

In some embodiments, the pump body may be formed to surround the rotor and the impeller overall between the stator and the rotor.

In some embodiments, the pump body may include: an upper body corresponding to the impeller and having the middle outlet formed on a side surface; a lower body corresponding to the rotor; and a body shaft provided at a lower center of the lower body.

In some embodiments, the electric water pump may further include a sealing member provided between the upper housing and the upper body. In particular, the sealing member includes a plurality of second middle outlets corresponding to the plurality of cooling water outlets.

In some embodiments, the driving device may include a driver; and a deceleration device transferring power generated by the driver to the pump body.

According to embodiments, functions of an electric water pump and a valve are integrated to perform pumping and distribution of cooling water by one component, thereby reducing manufacturing cost and assembly man-hour of a vehicle.

Besides, an effect which can be obtained or predicted by the embodiment of the present disclosure is directly or implicitly disclosed in detailed description of the embodiment of the present disclosure. In other words, various effects predicted according to the embodiments of the present disclosure are disclosed below.

BRIEF DESCRIPTION OF THE DRAWINGS

These drawings are for the purpose of describing an exemplary embodiment of the present disclosure, and therefore the technical spirit of the present disclosure should not be construed as being limited to the accompanying drawings.

Figure 1:
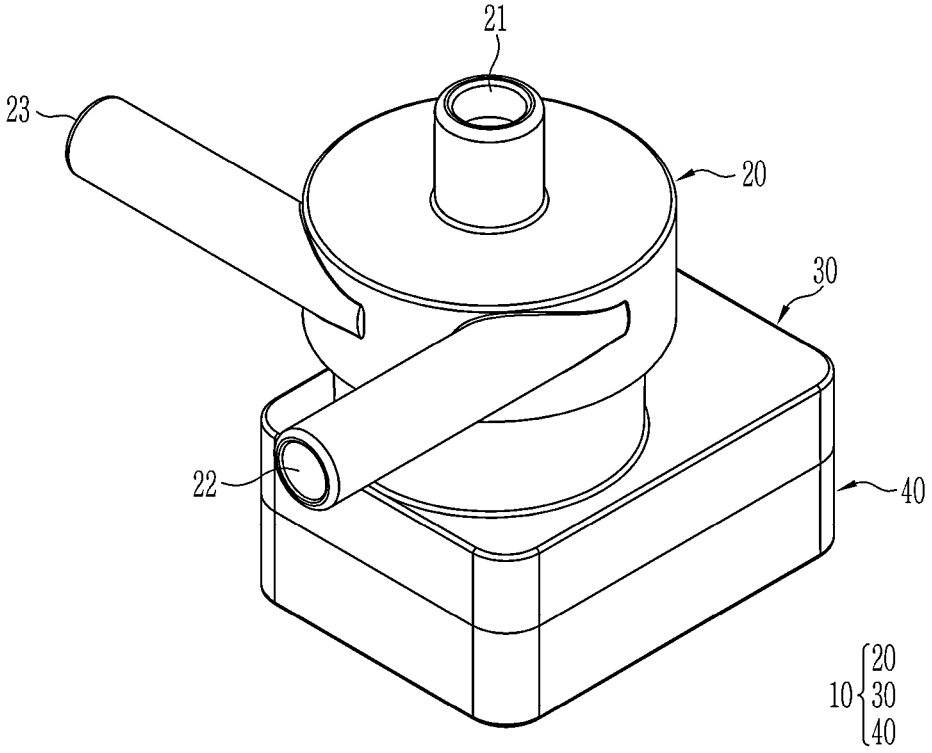
FIG. 1 is a perspective view illustrating a configuration of an electric water pump according to an embodiment.

The drawings referenced above are not particularly illustrated according to a scale, but should be understood as presenting a somewhat brief expression of various features that illustrate the basic principles of the present disclosure. For example, the specific design features of the present disclosure, including specific dimensions, directions, positions, and shapes, should be partially determined by specific intended applications and use environments.

DETAILED DESCRIPTION

The terms used here are only for describing specific embodiments, and are not intended to limit the present disclosure. As used here, the singular forms are also intended to include plural forms, unless they are explicitly differently indicated by context. It should be appreciated that when terms "include" and/or "including" are used in this specification, the terms "include" and/or "including" are intended to designate the existence of mentioned features, integers, steps, operations, constituent elements, and/or components, but do not exclude the existence or addition of one or more other features, integers, operations, constituent elements, and components, or groups thereof. As used herein, the terms "and/or" include any one or all combinations of the items which are associated and listed.

The present disclosure is described in detail so as to be easily carried out by those having ordinary skill in the art in a technical field to which the present disclosure pertains. However, the present disclosure can be realized in various different forms, and is not limited to the embodiments described herein.

A part irrelevant to the description has been omitted to clearly describe the present disclosure, and the same elements are designated by the same reference numerals throughout the specification.

Further, since size and thickness of each component illustrated in the drawings are arbitrarily represented for convenience in explanation, the present disclosure is not particularly limited to the illustrated size and thickness of each component and the thickness is enlarged and illustrated in order to clearly express various parts and areas.

Suffixes "module" and/or "unit" for components used in the following description are given or mixed in consideration of easy preparation of the present disclosure only and do not have their own distinguished meanings or roles.

Further, in describing embodiments, a detailed description of related known technologies has been omitted if it is determined that the detailed description makes the gist of the embodiment of the present disclosure unclear.

Further, the accompanying drawings are provided for helping to easily understand embodiments disclosed in the present specification, and the technical spirit disclosed in the present specification is not limited by the accompanying drawings, and it should be appreciated that the present disclosure includes all of the modifications, equivalent matters, and substitutes included in the spirit and the technical scope of the present disclosure.

Terms including an ordinary number, such as first and second, are used for describing various constituent elements, but the constituent elements are not limited by the terms. The terms are used only to discriminate one component from another component.

In the description below, the expression described by the singular can be interpreted as a singular or plurality, unless an explicit expression such as "one" or "single" is used.

When a component, device, element, or the like of the present disclosure is described as having a purpose or performing an operation, function, or the like, the component, device, or element should be considered herein as being "configured to" meet that purpose or to perform that operation or function.

Hereinafter, an electric water pump according to an embodiment is described in detail with reference to the accompanying drawings.

Figure 2:
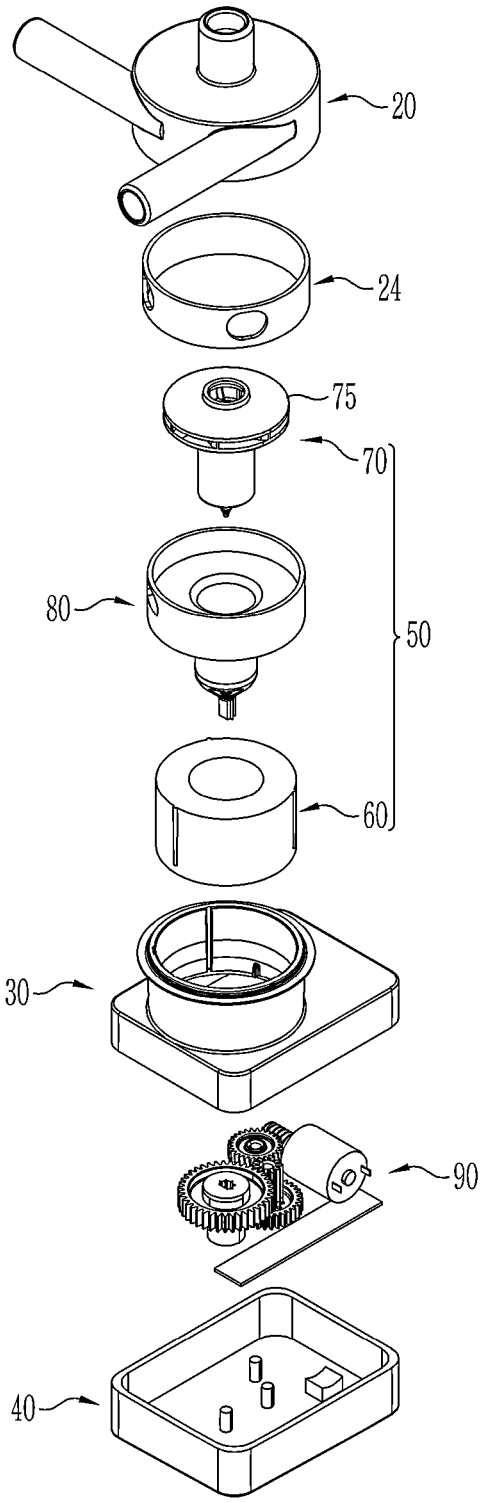
FIG. 2 is an exploded perspective view illustrating the configuration of the electric water pump according to an embodiment.

FIG. 1 is a perspective view illustrating a configuration of an electric water pump according to an embodiment. FIG. 2 is an exploded perspective view illustrating the configuration of the electric water pump according to an embodiment. In addition, FIG. 3 is a perspective view illustrating a configuration of an electric water pump according to an embodiment.

Figure 3:
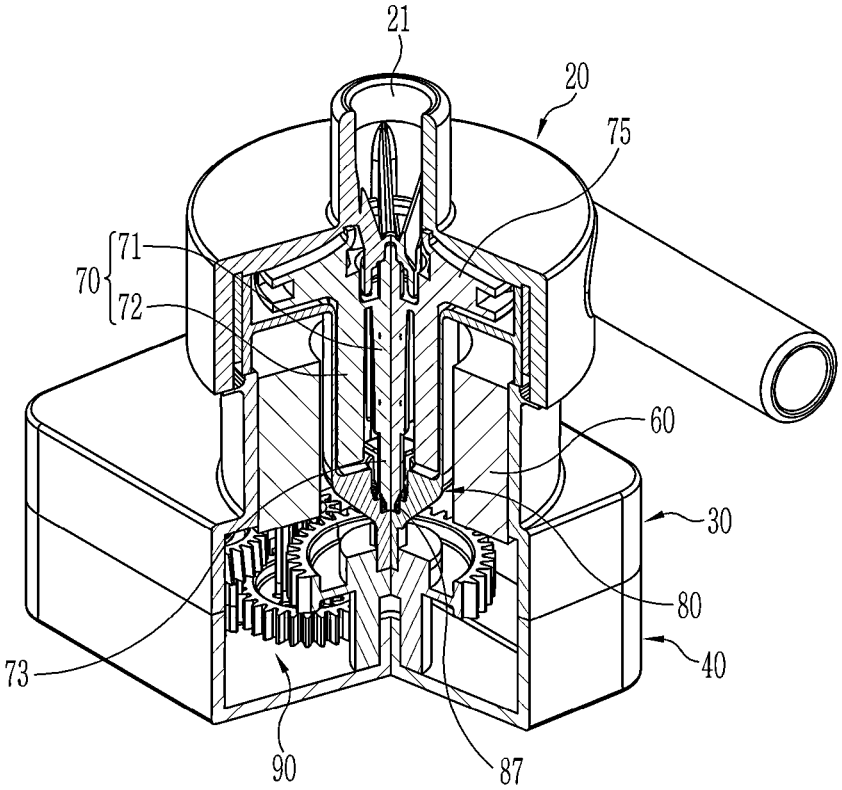
FIG. 3 is a partial cross-sectional perspective view illustrating a configuration of an electric water pump according to an embodiment.

As illustrated in FIGS. 1 to 3, the electric water pump according to an embodiment may include: a housing 10 in which a cooling water inlet 21 and a plurality of cooling water outlets are formed, and a driving motor 50 provided inside the housing 10. The driving motor 50 includes: a stator 60 and a rotor 70. The electric water pump further includes: an impeller 75 provided integrally with the rotor 70; a pump body 80 provided inside the housing 10 and formed to surround the driving motor 50 and the impeller 75; and a driving device 90 rotating the pump body 80 at a predetermined angle.

The housing 10 may include an upper housing 20, a middle housing 30, and a lower housing 40.

Figure 4:
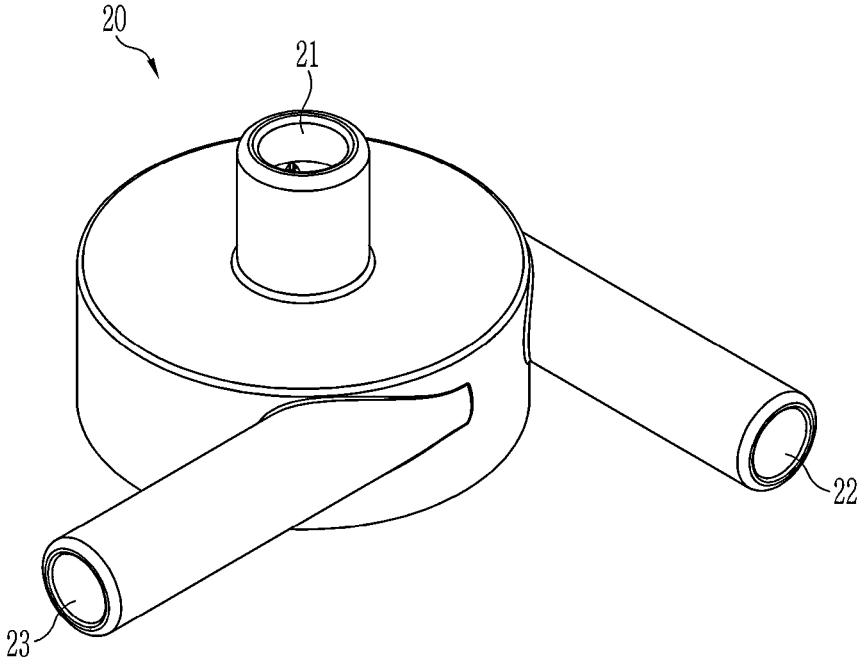
FIG. 4 is a perspective view illustrating a configuration of an upper housing according to an embodiment.

Referring to FIG. 4, the upper housing 20 is formed in an approximately hollow cylindrical shape, and a lower portion is opened. The cooling water inlet 21 through which cooling water is introduced is formed at an upper center of the upper housing 20, and a plurality of cooling water outlets through which the cooling water is discharged are formed on a side surface of the upper housing 20.

The cooling water outlets may include a first cooling water outlet 22 formed on the side surface of the upper housing 20, and a second cooling water outlet 23 disposed to be spaced apart from the first cooling water outlet 22 at a predetermined angle in a circumferential direction of the upper housing. In an embodiment, it is described that there are two cooling water outlets, but the scope of the present disclosure is not limited thereto, and the number of cooling water outlets may be appropriately adjusted as necessary.

Figure 5:
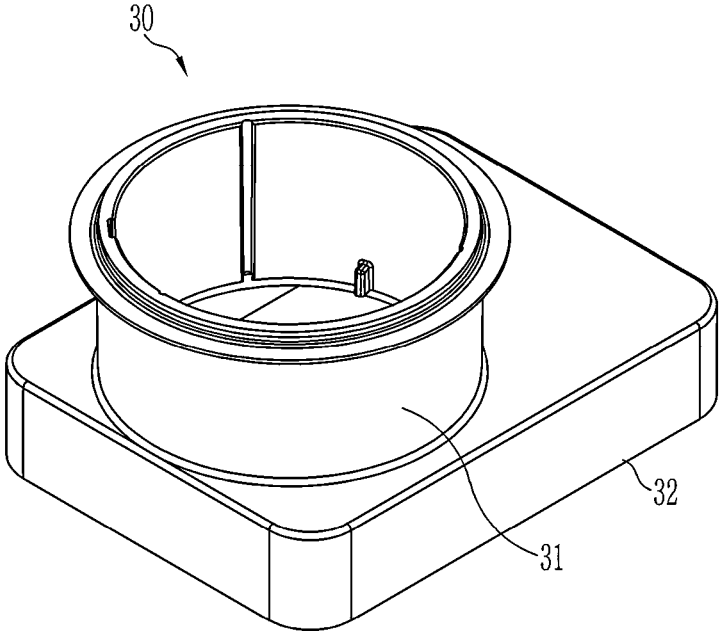
FIG. 5 is a perspective view illustrating a configuration of a middle housing according to an embodiment.

Referring to FIG. 5, the middle housing 30 is provided below the upper housing 20. The middle housing 30 may include a first middle housing 31 formed in the approximately hollow cylindrical shape, and a second middle housing 32 having an approximately hollow square shape, which is provided below the first middle housing 31. An upper portion and a lower portion of the middle housing 30 are opened.

The driving motor 50, the impeller 75, and the pump body 80 may be provided in an inner space formed by coupling the upper housing 20 and the middle housing 30. The stator 60 may be fixedly installed at an inner side of the first middle housing 31 of the middle housing 30.

The lower housing 40 is provided below the middle housing 30, and is formed in a hollow square shape, and an upper portion of the lower housing 40 is opened. The lower housing 40 is formed in a shape corresponding to a lower portion of the first middle housing 31 of the middle housing 30. The driving device 90 may be installed in an inner space formed by coupling the second middle housing 32 of the middle housing 30 and the lower housing 40.

Referring back to FIGS. 2 and 3, the stator 60 may be formed in an approximately circular ring shape to sufficiently form a rotation magnetic field, and may include a stator core (not illustrated) and a stator coil (not illustrated). The stator core may be made of a metallic material, and the stator coil is wound on the stator core.

Figure 6:
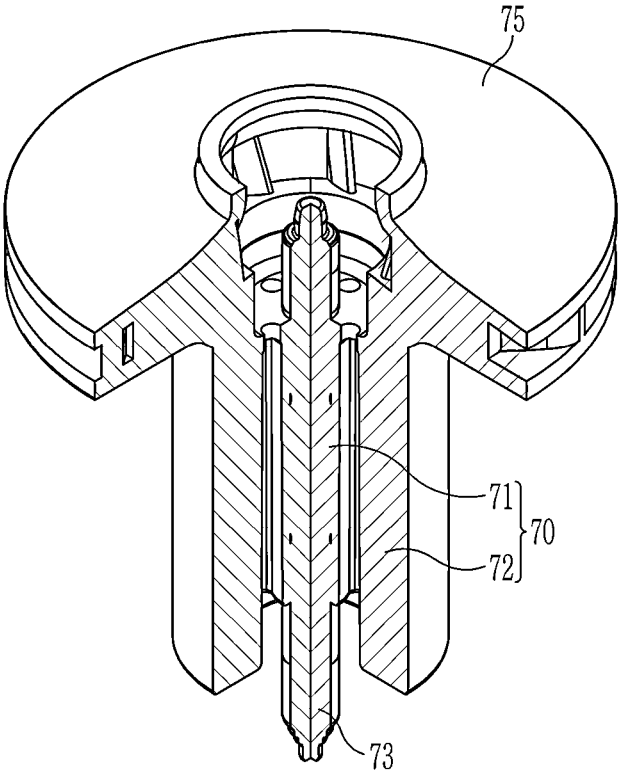
FIG. 6 is a cross-sectional perspective view illustrating configurations of a rotor and an impeller according to an embodiment.

Referring to FIG. 6, the rotor 70 may include a rotation body 71, and at least one magnetic body 72 provided outside a radial direction of the rotation body 71. The rotation body 71 is rotatably provided at the center of the housing 10, and formed in a cylindrical shape. A rotary shaft 73 may be provided at a lower portion of the rotation body 71, and the rotary shaft 73 may be rotatably provided inside the pump body 80. In one form, a plurality of magnetic bodies 72 may be provided outside the radial direction of the rotation body 71 in the circumferential direction of the rotation body 71. In other words, the magnetic bodies 72 may be positioned circumferentially outside the radial direction of the rotation body 71. The magnetic body 72 may be a permanent magnet.

The rotor 70 rotates by an electromagnetic action of the stator 60 and the rotor 70.

The impeller 75 may be integrally provided at the upper portion of the rotation body 71 of the rotor 70. The impeller 75 rotates with the rotation of the rotor 70. The impeller 75 pumps the cooling water introduced through the cooling water inlet 21, and the cooling water pumped by the impeller 75 is discharged to the outside through any one cooling water outlet of the plurality of cooling water outlets.

The pump body 80 may be provided between the stator 60 and the rotor, and formed to surround the rotor 70 and the impeller 75 overall.

Figure 7A:
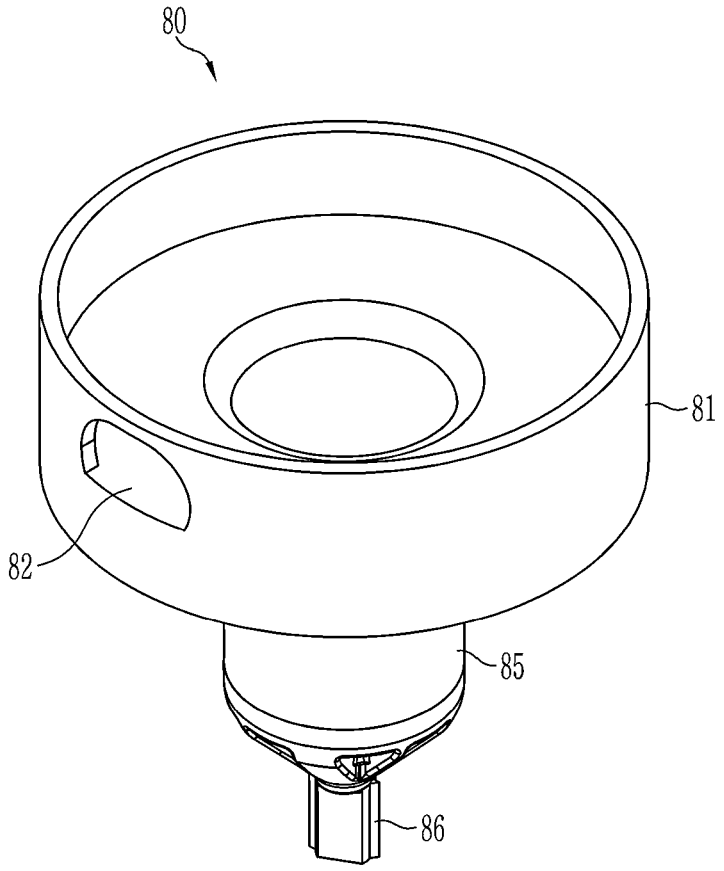
FIG. 7A is a perspective view illustrating a configuration of a pump body according to an embodiment.
Figure 7B:
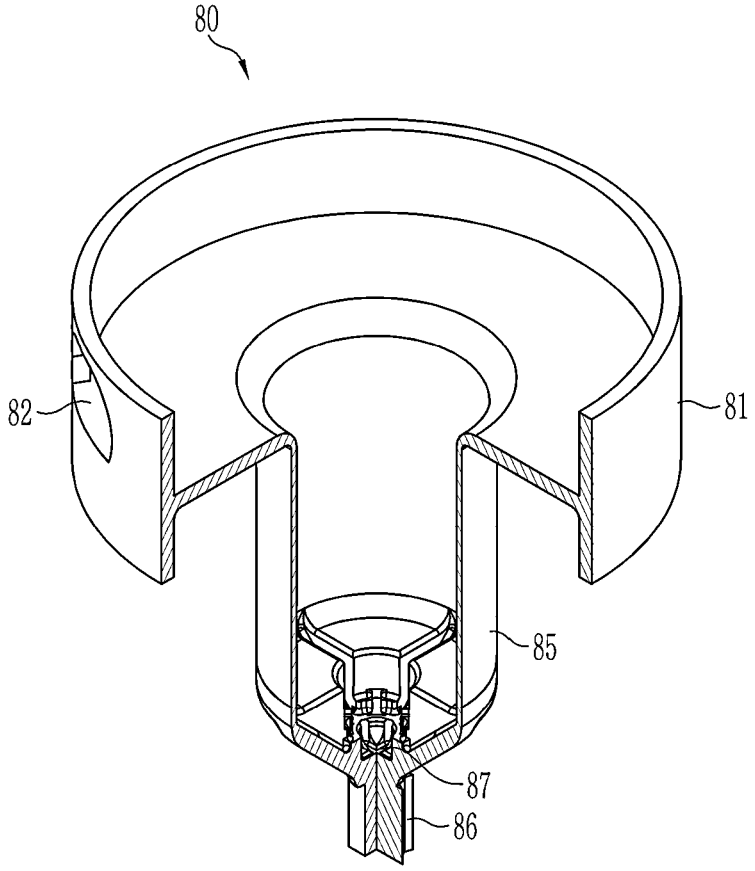
FIG. 7B is a partial cross-sectional perspective view illustrating the configuration of the pump body according to an embodiment.

Referring to FIGS. 7A and 7B, the pump body 80 may include an upper body 81, a lower body 85 provided below the upper body 81, and a body shaft 86 provided at a lower center of the lower body 85.

The upper body 81 may be formed in a shape corresponding to the impeller 75, and a first middle outlet 82 may be formed on a side surface of the upper body 81. In other words, the upper body 81 may be formed in the approximately cylindrical shape to surround an exterior of the impeller 75, except for the upper portion of the impeller 75. The upper body 81 may include: an upper portion that is opened overall, and a lower center that also is opened. The first middle outlet 82 formed on a side surface of the upper body 81 may selectively fluidly communicate with any one of the plurality of cooling water outlets formed in the upper housing 20.

The lower body 85 may be formed in a shape corresponding to the rotation body 71. In other words, the lower body 85 may be formed in the approximately hollow cylindrical shape to be formed in a shape to surround the exterior of the rotor 70 overall, and connected to the opened lower center of the upper body 81. The lower portion of the lower body 85 may be formed in a conical shape in which a radius gradually becomes smaller downwards. A seating groove 87 on which the rotary shaft 73 of the rotor 70 is rotatably seated may be formed at the lower portion of the lower body 85.

The body shaft 86 is formed to protrude from the lower center of the lower body 85, and rotates by receiving the power from the driving device 90.

Figure 8:
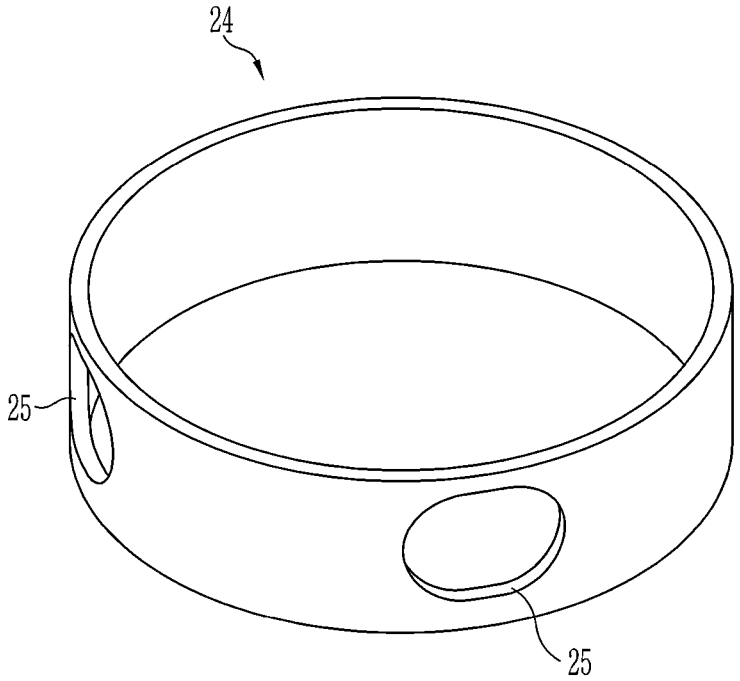
FIG. 8 is a perspective view illustrating a configuration of a sealing member according to an embodiment.

In another embodiment, the sealing member 24 may be provided between the upper housing 20 and the upper body 81. In particular, the sealing member 24 may include a plurality of second middle outlets 25 corresponding to the plurality of cooling water outlets. Referring to FIG. 8, the sealing member 24 may be provided between an outer side of the upper body 81 and an inner side of the upper housing 20. The sealing member 24 may be formed in an approximately ring shape. In addition, the plurality of second middle outlets 25 corresponding to the cooling water outlets of the upper housing 20 are formed in the sealing member 24. The second middle outlets 25 may be disposed to be spaced at a predetermined angle in the circumferential direction.

Figure 9:
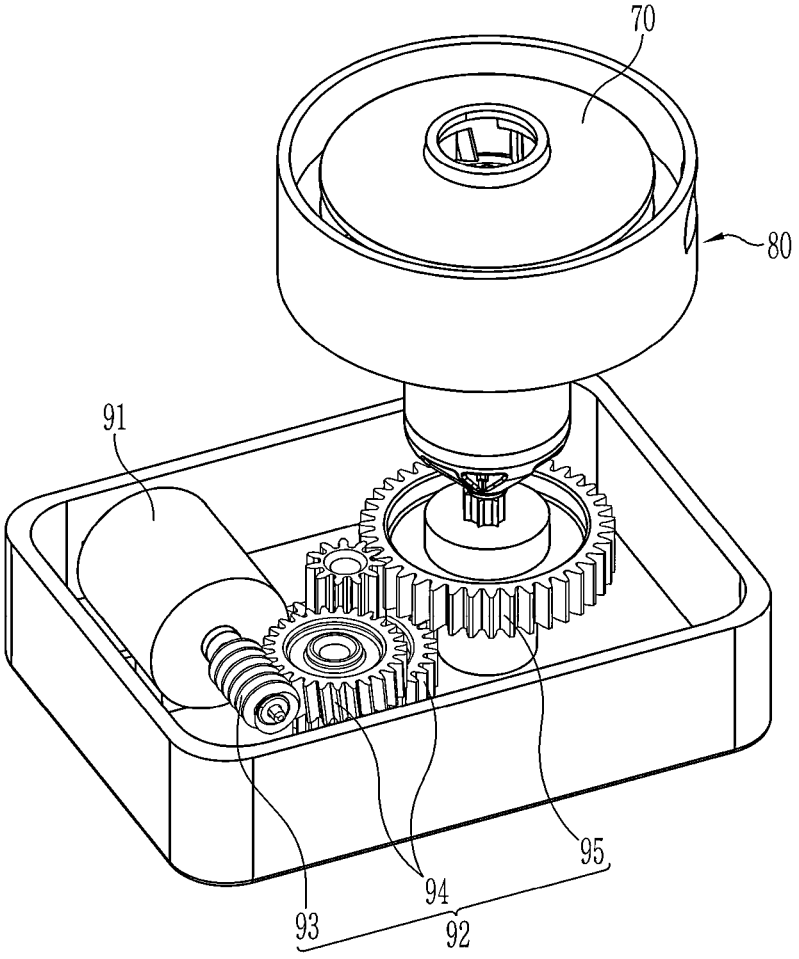
FIG. 9 is a perspective view illustrating configurations of a driving device and the pump body according to an embodiment.

The driving device 90 provides power for rotating the pump body 80 at a predetermined angle. Referring to FIG. 9, the driving device 90 may include a driver 91, and a deceleration device 92 transferring the power of the driver 91 to the pump body 80. The pump body 80 rotates at a predetermined angle by the driving device 90, and the first middle outlet 82 of the pump body 80 selectively fluidly communicates with any one of the plurality of cooling water outlets formed in the upper housing 20.

The driver 91 may be implemented as an electric motor that generates power by electric power supplied from the outside.

The deceleration device 92 may be implemented through a gear train. To this end, the deceleration device 92 may include a driving gear 93 coupled to the rotary shaft of the driving motor 50, a driven gear 95 coupled to the body shaft 86 of the pump body 80, and at least one intermediate gear 94 gear-coupled between the driving gear 93 and the driven gear 95.

The power generated by the driver 91 is transferred to the pump body 80 as a speed decreases and a torque increases through the deceleration device 92.

Hereinafter, an operation of the electric water pump according to an embodiment is described in detail.

Cooling water which flows on a cooling water line provided outside the electric water pump is introduced into the electric water pump through the cooling water inlet 21 of the upper housing 20.

Figure 10A:
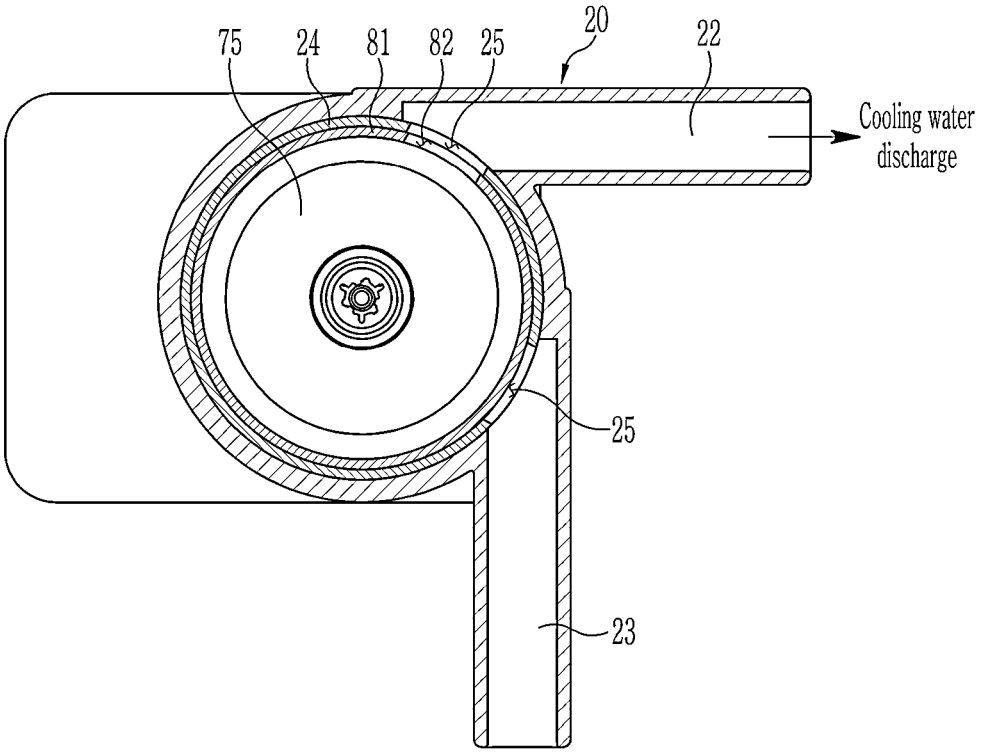
FIGS. 10A and 10B are diagrams illustrating an operation of the electric water pump according to an embodiment.

The cooling water introduced into the electric water pump is pumped by the impeller 75 which rotates by actuation of the driving motor 50, and the cooling water pumped by the impeller 75 is discharged to the outside of the electric water pump through the first cooling water outlet 22. In this case, the first middle outlet 82 formed in the upper body 81 of the pump body 80 may be in a state of fluidly communicating with the first cooling water outlet 22 formed in the upper housing 20 (see FIG. 10A).

Figure 10B:
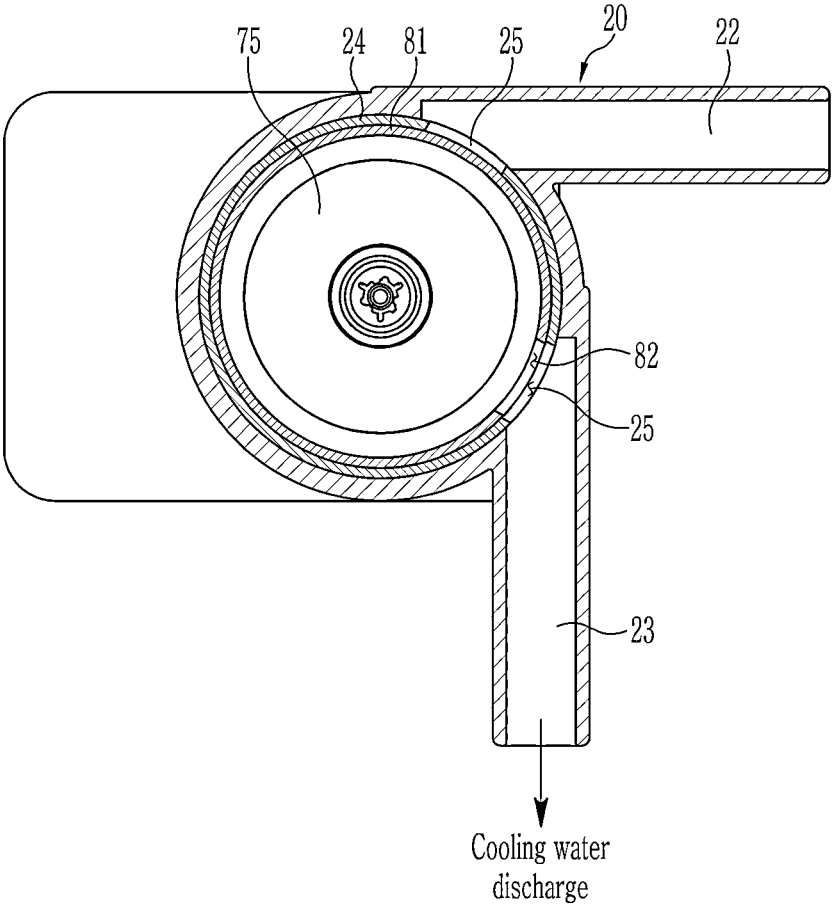

When a discharge path of the cooling water discharged from the electric water pump is changed, the pump body 80 rotates at a predetermined angle by actuation of the driving device 90. As a result, the first middle outlet 82 formed in the upper body 81 of the pump body 80 is fluidly communicated with the second middle outlet 25 formed in the upper housing 20 (see FIG. 10B). Accordingly, the cooling water pumped by the impeller 75 is discharged to the outside of the electric water pump through the second cooling water outlet 23.

According to an embodiment, the cooling water introduced into the electric water pump may be selectively discharged through the plurality of cooling water outlets. As a result, a path of the cooling water pumped from the electric water pump need not be changed through a separate valve device, thereby reducing manufacturing cost, weight, and assembly man-hour of the vehicle.

Although some embodiments of the present disclosure have been described hereinabove, the present disclosure is not limited thereto, and various modifications can be made within the scope of the claims. Those having ordinary skill in the art should appreciate that various modifications, additions and substitutions are possible, without departing from the scope and spirit of the present disclosure.

DESCRIPTION OF SYMBOLS

10: Housing
20: Upper housing
21: Cooling water inlet
22: First cooling water outlet
23: Second cooling water outlet
24: Sealing member
25: Second middle outlet
30: Middle housing
31: First middle housing
32: Second middle housing
40: Lower housing
50: Driving motor
60: Stator
70: Rotor
71: Rotation body
72: Magnetic body
73: Rotation shaft
75: Impeller
80: Pump body
81: Upper body
82: First middle outlet
85: Lower body
86: Body shaft
87: Seating groove
90: Driving device
91: Driver
92: Deceleration device
93: Driving gear
94: Intermediate gear
95: Driven gear

What is claimed is:

1. An electric water pump comprising:
a housing in which a cooling water inlet and a plurality of cooling water outlets are formed;
a stator provided inside the housing;
a rotor provided inside the housing, and provided to be spaced apart from the stator at a predetermined interval in a radial direction of the rotor;
an impeller provided integrally with an upper portion of the rotor;
a pump body provided between the stator and the rotor, and having a first middle outlet; and
a driving device configured to selectively fluidly communicate with any one of the plurality of cooling water outlets, and the first middle outlet by rotating the pump body at a predetermined angle.

2. The electric water pump of claim 1, wherein the housing includes:
an upper housing;
a middle housing provided below the upper housing; and
a lower housing provided below the middle housing, and
wherein the stator, the rotor, the impeller, and the pump body are provided between the upper housing and the middle housing.

3. The electric water pump of claim 2, wherein:
the stator is fixedly installed on an inner side of the middle housing.

4. The electric water pump of claim 2, wherein:
the cooling water inlet is formed at an upper center of the upper housing, and
the plurality of cooling water outlets are formed on a side surface of the upper housing.

5. The electric water pump of claim 4, wherein the plurality of cooling water outlets includes:
a first cooling water outlet, and
a second cooling water outlet spaced apart from the first cooling water outlet at a predetermined angle in a circumferential direction of the upper housing.

6. The electric water pump of claim 2, wherein the driving device
is provided inside the lower housing.

7. The electric water pump of claim 1, wherein the rotor includes:
a rotation body, and
at least one magnetic body provided outside in a radial direction of the rotation body.

8. The electric water pump of claim 1, wherein the pump body is formed to surround the rotor and the impeller overall between the stator and the rotor.

9. The electric water pump of claim 8, wherein the pump body includes:
an upper body corresponding to the impeller, and having the first middle outlet formed on a side surface thereof,
a lower body corresponding to the rotor, and
a body shaft provided at a lower center of the lower body.

10. The electric water pump of claim 9, further comprising:
a sealing member provided between an upper housing of the housing and the upper body, wherein the sealing member includes a plurality of second middle outlets corresponding to the plurality of cooling water outlets.

11. The electric water pump of claim 1, wherein the driving device includes:
a driver; and
a deceleration device configured to transfer power generated by the driver to the pump body.

* * * * *